US006445402B1

(12) United States Patent
Kinjyo et al.

(10) Patent No.: US 6,445,402 B1
(45) Date of Patent: Sep. 3, 2002

(54) CONTACT TYPE RECORDING HEAD AND IMAGE FORMING APPARATUS USING THE RECORDING HEAD

(75) Inventors: Kazuaki Kinjyo; Mitsuru Sawano, both of Shizuoka (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/518,373

(22) Filed: Mar. 3, 2000

(30) Foreign Application Priority Data

Mar. 4, 1999 (JP) ..... 11-057296

(51) Int. Cl.[7] ..... B41J 2/335
(52) U.S. Cl. ..... 347/200; 347/203
(58) Field of Search ..... 347/200, 203

(56) References Cited

FOREIGN PATENT DOCUMENTS

JP 57-167277 * 10/1982

JP 2000-141729 * 5/2000

* cited by examiner

*Primary Examiner*—Huan Tran
(74) *Attorney, Agent, or Firm*—Sughrue Mion, PLLC

(57) ABSTRACT

In a contact type recording head which moves relatively with respect to the recording material while its one portion is coming into contact with the recording material, and directly prints an image onto the recording material or indirectly prints an image onto the recording material through the recording material, the microscopic irregularity is provided on a material contact portion S of the heating element 45 which comes into contact with the recording material. It is preferable that the microscopic irregularity is formed in a streak-like manner in the direction of the relative movement with the recording material, and the average roughness Ra of the microscopic irregularity in the perpendicular direction to the relative movement direction is 0.03–0.5 $\mu$m.

12 Claims, 9 Drawing Sheets

CONTACT TYPE RECORDING HEAD AND IMAGE FORMING APPARATUS USING THE RECORDING HEAD

BACKGROUND OF THE INVENTION

The present invention relates to a contact type recording head which is relatively moved while its one portion being brought into contact with recording material (thermal transfer recording material, heat sensitive material, photosensitive heat sensitive transfer material, etc.) and which directly prints an image onto the recording material or indirectly prints an image onto an image receiving material through the recording material, and to an image forming apparatus using this contact type recording head.

For example, a thermal head, which is a contact type recording head, has heating elements arranged in an array-like manner in the direction of rotation axis of a platen, and forms an image onto the recording material by selecting and heating the heating elements corresponding to an image to be printed onto the recording material inserted between the platen and the heating elements. In this case, when the above-described recording material is a thermal transfer recording material (for example, ink ribbon), the ink of the ink ribbon is thermaly transferred onto the image receiving surface of the image receiving material as an image by the heating of the heating elements. When the recording material is heat sensitive material (heat sensitive paper) , an image is directly formed on the heat sensitive paper by the heating of the heating elements.

Incidentally, the conventional heating element is formed such that a convex glaze layer is formed on a ceramic substrate, and a resistance heating element, electrode layer, and protective layer are successively laminated thereon. Accordingly, the heating element contacts with the material through the protective layer. The protective layer is formed as the smooth one, and generally, the recording material is formed also as the smooth one by coating wax, or the like, on the contact surface with the head so as to reduce the frictional resistance.

However, in the contact type recording head which records an image by contacting with the recording material, the frictional resistance between the head and the recording material largely changes corresponding to the existence of the printing image, that is, an image-printing rate. Accordingly, in the case where the arrangement direction of a heating section is defined as the primary scanning direction, and the direction of the relative movement of the recording material with the head is defined as the subsidiary scanning direction, when an intermediate color printing area to continuously print the intermediate color in the subsidiary scanning direction, and a binary level printing area to alternately print white or black in the subsidiary scanning direction, are mixed, the frictional resistance between the recording material and the head changes due to a change of the image-printing rate in the binary level printing area, and a printing failure of so-called line-jumping which appears as a line-image in an intermediate color printing area, is generated. Further, in the contact type recording head using the recording material on which wax is coated, a fused amount of wax changes according to the image-printing rate, and thereby, the frictional resistance changes, resulting in a printing failure.

Further, when the head and the recording material are both formed with high smoothness, as described above, in addition to that the frictional resistance largely changes corresponding to the image-printing rate, a width of increase of the frictional resistance at that time tends to increase, and a large burden is loaded on component parts of a conveyance mechanism, which is a problem.

SUMMARY OF THE INVENTION

The present invention is attained in view of the foregoing situation, and the object of the present invention is to provide a contact type recording head by which a change of the frictional resistance due to the difference of the image-printing rate can be smaller, the image printing quality is increased, and a burden loaded on the component parts of the apparatus can be reduced, and an image forming apparatus using that head.

In order to attain the above object, a contact type recording head according to the present invention is structured as follows.

(1). A contact type recording head which moves relatively with respect to the recording material while its one portion being brought into contact with the recording material, and directly prints an image onto the recording material or indirectly prints an image onto an image receiving material through the recording material, the contact type recording head is characterized in that microscopic irregularity is provided on a material contact portion of the head with the recording material.

In the contact type recording head, the microscopic irregularity is provided on the material contact portion with the recording sheet, thereby, a change of the frictional resistance of the material contact portion with the recording material, which, conventionally, largely changes due to a change of the image-printing rate, is suppressed smaller, and a printing failure such as a line-jumping, or the like, hardly occurs. Further, when the difference of the change of the frictional resistance of the material contact portion with the recording material is made small, a change of the conveyance driving torque is smaller, and thereby, the durability of the component parts of the apparatus can be increased.

(2). A contact type recording head according to Item (1), wherein the microscopic irregularity is formed in a streak-like manner in the direction of the relative movement.

In this contact type recording head, the microscopic irregularity is formed in a streak-like manner in the direction of the relative movement to the recording material, therefore, the friction between the recording head and the recording material at the time of relative movement is not increased, and the contact surface of the recording head with the recording material is decreased. Further, when an abrasive sheet is inserted and passed through between the recording head and the recording material, the streak-like microscopic irregularity can be easily formed in the direction of the relative movement.

(3). A contact type recording head according to either one of Item (1) or Item (2), wherein the microscopic irregularity has an average roughness of 0.03–0.5 $\mu$m in the direction perpendicular to the direction of the relative movement.

In this contact type recording head, the microscopic irregularity is formed such that the average roughness in the direction perpendicular to the direction of the relative movement is 0.03–0.5 $\mu$m which is the appropriate roughness, therefore, the same printing failure as in the conventional head, caused by insufficient microscopic irregularity roughness, and reversely, uneven density caused when the microscopic irregularity is too rough, are both eliminated, thereby, good printing can be performed.

(4). A contact type recording head according to any one of Items (1)–(3), wherein a plurality of heating elements are arranged in the array-like manner on the material contact portion with the recording material.

This contact type recording head is used as so-called thermal head, in which heating elements are selected and heated, and thereby an image is thermally transferred. In this case also, a change of the frictional resistance between the material contact portion of the head and the recording material is reduced, and the printing failure due to a change of the image-printing rate hardly occurs. Further, because the contact area of the material contact portion is decreased, even if wax coated on the recording material is fused, a change of the frictional resistance can be suppressed to be smaller.

(5). An image forming apparatus is characterized in that the contact type recording head of any one of Items (1)–(4) is installed in the apparatus as a recording head.

In this image forming apparatus, the contact type recording head in which a change of the frictional resistance due to the difference of the image-printing rate is small, is installed, and therefore, generation of the printing failure such as line-jumping or the like, can be prevented, thereby, the printing quality can be increased.

(6). An image forming apparatus according to Item (5), wherein the average roughness of the surface of the recording material on which the recording head slides, is not more than 0.5 $\mu$m.

In this contact type recording head, even if the recording material has high flatness in which the average roughness is not more than 0.5 $\mu$m, it is coupled with the roughness of the head, and the frictional resistance becomes small and stable by the multiplication of the two, thereby, a change of the frictional resistance can be more effectively suppressed.

(7). An image forming apparatus according to either one of Items (5) or (6), wherein the recording material is thermal transfer recording material or heat sensitive material.

In this image forming apparatus, when the recording material is thermal transfer recording material, the head comes into contact with the thermal transfer recording material under the condition that a change of the frictional resistance is small, and by the heating of the head, an image is indirectly thermally transferred onto the image receiving surface of the recording material through the thermal transfer recording material. When the recording material is heat sensitive material, the head comes into contact with the heat sensitive material under the condition that a change of the frictional resistance is small, and by the heating of the head, an image is directly thermally transferred onto the heat sensitive material.

(8). An image forming apparatus according to either one of Items (5) or (6), wherein the recording material is heat sensitive transfer recording material which includes pigment of 30–70 weight parts and amorphous organic high polymer of 25–50 weight parts whose softening point is 40–150° C., and has practically transparent heat sensitive ink layer whose film thickness is within the range of 0.2–1.0 $\mu$m, and wherein the particle diameter of more than 70% of the pigment in the heat sensitive ink layer is not more than 1.0 $\mu$m, and the optical reflection density of the transfer image is at least not less than 1.0 on the white base material.

In the image forming apparatus, when the recording material is heat sensitive transfer recording material of color material which is close to the practical printing ink, the texture or hue of the recording result can be equivalent to the print, thereby, the high quality image formation with excellent color reproducibility can be performed.

DETAILED DESCRIPTION OF THE PREFERRED EMBODIMENTS

Figure 1:
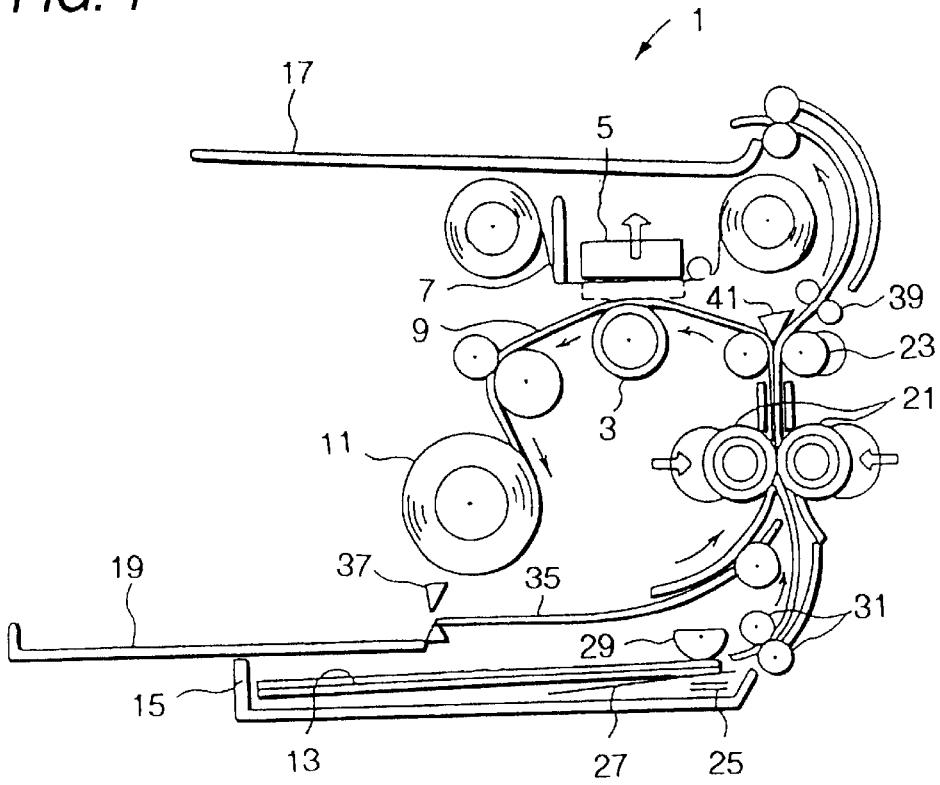
FIG. 1 is a schematic structural view of an image forming apparatus provided with a contact type recording head according to the present invention.

Referring to the drawings, an preferred embodiment of a contact type recording head according to the present invention and an image forming apparatus using the head will be detailed below.

Figure 2:
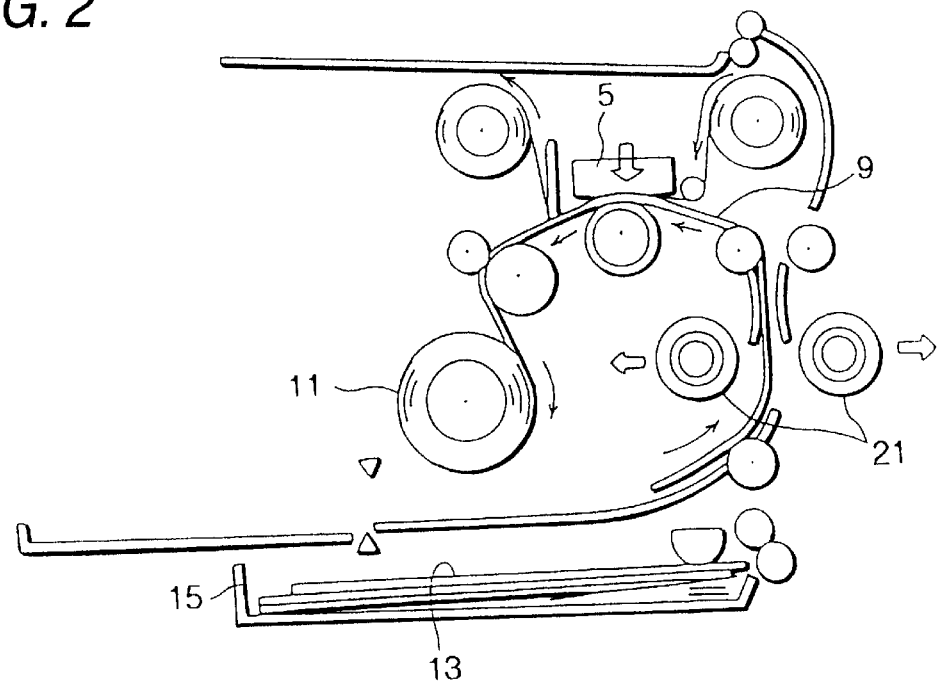
FIG. 2 is a schematic structural view showing a condition of operation in FIG. 1.
Figure 3:
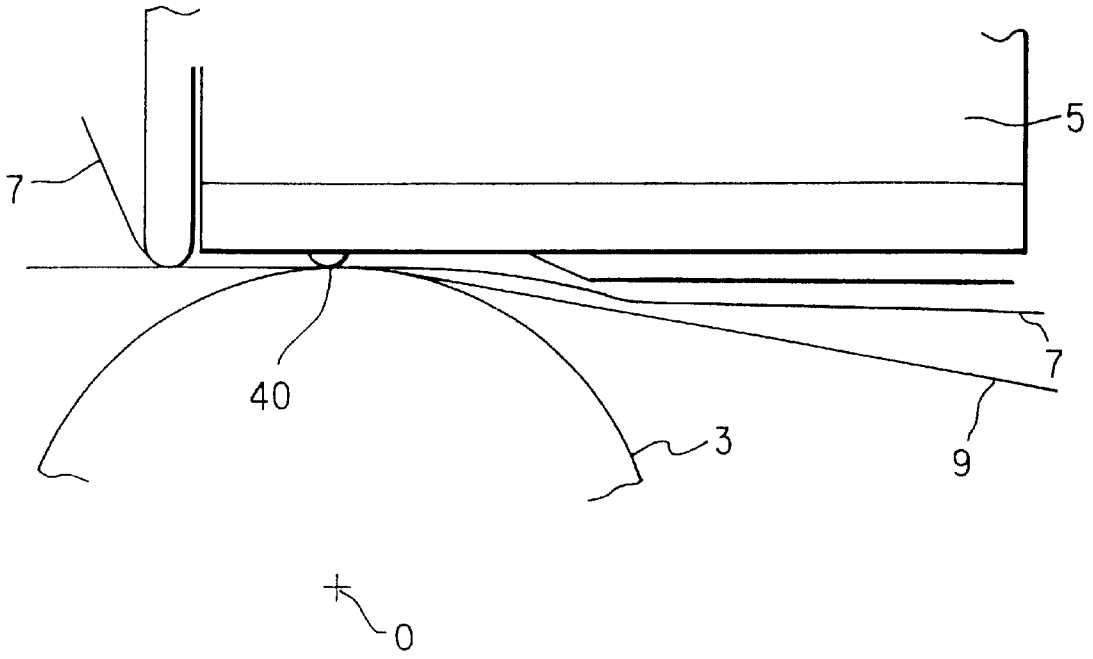
FIG. 3 is an enlarged side view of the contact type recording head shown in FIG. 1.
Figure 4:
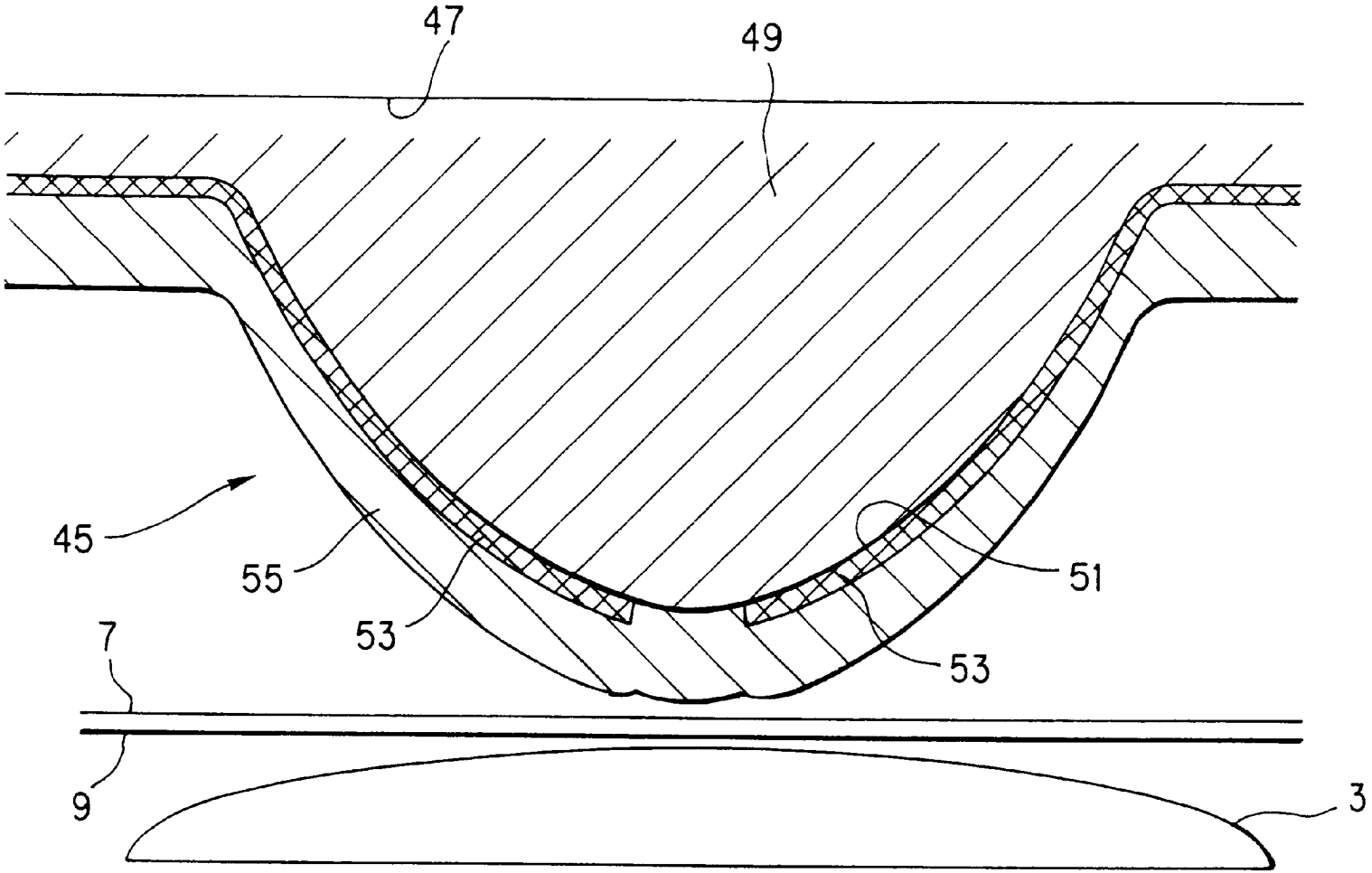
FIG. 4 is an enlarged sectional view of a heating element shown in FIG. 3.
Figure 5:
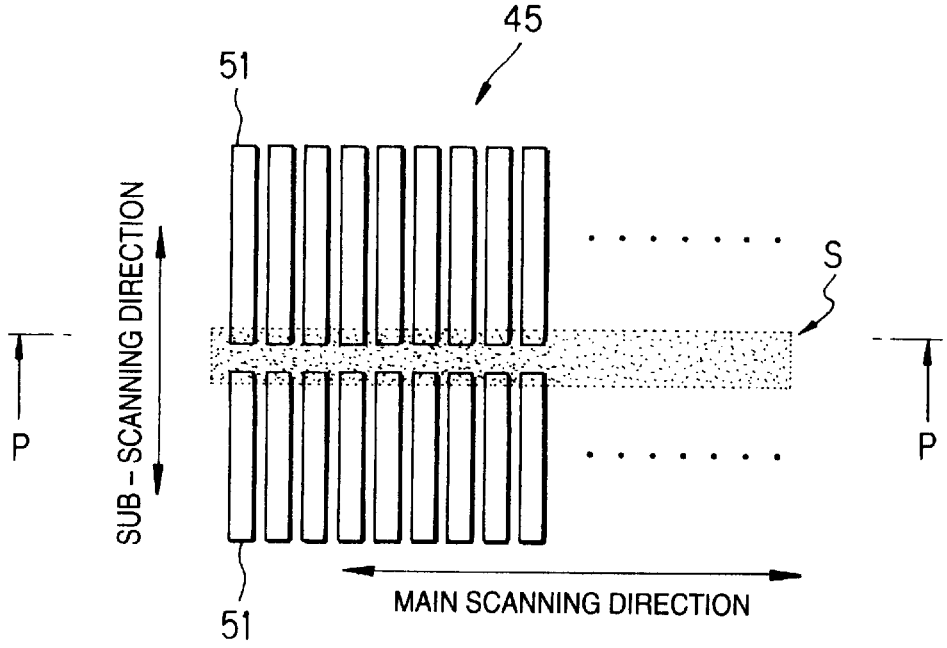
FIG. 5 is an enlarged view of a main portion of the contact type recording head according to the present invention.
Figure 6:
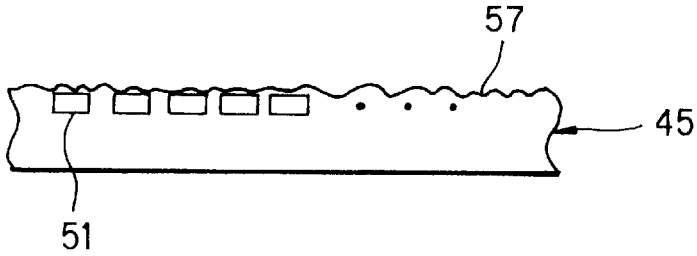
FIG. 6 is a sectional view taken on line P—P in FIG. 5.

FIG. 1 is a schematic structural view of an image forming apparatus provided with a contact type recording head according to the present invention, and FIG. 2 is a schematic structural view showing a condition of the operation in FIG. 1. FIG. 3 is an enlarged side view of the contact type recording head shown in FIG. 1, and FIG. 4 is an enlarged sectional view of the heating element shown in FIG. 3. FIG. 5 is an enlarged view of a main portion of the contact type recording head according to the present invention, and FIG. 6 is a sectional view taken on line P—P in FIG. 5.

As shown in FIG. 1, an image forming apparatus 1 is provided with the following components as main components: a platen 3; a contact type recording head (for example, thermal head 5) opposite to the platen 3; a recording material (an ink ribbon 7) and image receiving material which are fed together while being nipped between the platen 3 and the thermal head 5 in accordance with an image recording; a supply roller 11 around which the image receiving material; (a receiver sheet 9) is wound; a principal sheet feed cassette 15 to accommodate the principal sheet 13; a delivery sheet tray 17 onto which the principal sheet, onto which an image is transferred, by the receiver sheet 9 is delivered; a discard tray 19 onto which the receiver sheet 9 is discarded after the image is transferred onto the principal sheet 13; heat roller pair 21; and a peeling roller 23.

A metal plate 27 forced upward by a spring 25 is provided in a principal sheet feed cassette 15, and the metal plate 27 forces the principal sheet 13 upward and presses it to a pick-up roller 29. An uppermost sheet of the principal sheets 13 pressed to the pick-up roller 29 is sent out by the rotation of the pick-up roller 29, and inserted between the heat roller pair 21 by sheet feed rollers 31.

The heat roller pair 21 can be reversibly rotated, and is structured such that these rollers can be moved in the direction that these rollers come close to each other, and separate from each other. The heat roller pair 21 conveys the sheet (the receiver sheet 9 and the principal sheet 13) while pressing and heating it, under the condition that these rollers are moved in the direction that they come close to each other, and the pressing and heating toward the sheet are released under the condition that these rollers are moved in the direction that they are separated from each other.

A cutter 37 is provided on a discarding path 35 between the heat roller pair 21 and the discard tray 19, and the cutter 37 cuts the transferred receiver sheet 9 conveyed on the discarding path 35.

In the image forming apparatus 1 structured as described above, at the time of recording an image a certain length of the receiver sheet 9 is fed out from the supply roller 11 in advance, and an image is recorded on the receiver sheet 9 by the thermal head 5 on such a condition that the receiver sheet 9 is overlaid by the ink ribbon 7 while the receiver sheet 9 is being wound around the supply roller 11 again as shown in FIG. 2. In this case, the heat roller pair 21 is on standby under the condition that two rollers are moved in the separating direction, and is in no-contact with the receiver sheet 9.

After the image has been transferred onto the receiver sheet 9 through the ink ribbon 7, transferring the image being formed on the receiver sheet 9 onto the principal sheet 13 is further performed. In order to transfer onto the principal sheet 13, the receiver sheet 9 on which an image is already transferred is sent out for a certain length again, and the leading edge portion of the receiver sheet 9 is positioned at an insertion position of the heat roller pair 21. Next, as shown in FIG. 1, the principal sheet 13 is pulled out of the principal sheet feed cassette 15 by the pick-up roller 29. At the time when the leading edge of the principal sheet 13 has passed the heat roller pair 21, the heat roller pair 21 is moved in the close direction, and both the receiver sheet 9 and the principal sheet 13 are conveyed upward in FIG. 1, while being pressed and heated together. In this case, when both rollers of the heat roller pair 21 come close to each other at the time when the leading edge of the principal sheet 13 has passed the heat roller pair 21, the leading edge of the principal sheet 13 is not adhered to the receiver sheet 9.

Next, the leading edge of the principal sheet 13 which is not adhered to the receiver sheet 9, is peeled off by a peeling roller 23, and the principal sheet 13 peeled off from the receiver sheet 9 is delivered onto the delivery tray 17 by a conveyance roller 39. In this connection, the peeling of the principal sheet 13 can be more surely performed by inserting a tip of a peeling claw 41 between the receiver sheet 9 and the principal sheet 13.

Then, both rollers of the heat roller pair 21 are separated from each other again when the trailing edge of the principal sheet 13 has passed the heat roller pair 21, and return to the standby position.

On the other hand, the receiver sheet 9 sends out a portion which is transferred onto the principal sheet 13, to the position of the cutter 37, and a transferred portion is cut off and discarded onto the discard tray 19. Incidentally, the sending out process of the receiver sheet 9 for this discarding, is also used as the sending out process for the preparation of the next image recording.

Herein, the thermal head 5 has, as shown in FIG. 3, heating elements 45 arranged in the array-like manner in the direction of the rotation central shaft O of the platen 3, and the heating elements 45 corresponding to an image to be printed are selected and heated, and thereby, the thermal head 5 thermally transfers the image onto the image receiving surface of the receiver sheet 9, inserted between the platen 3 and the heating elements 45, through the ink ribbon 7.

As shown in FIG. 4, the heating element 45 is formed such that a convex glaze layer 49 is formed on a ceramic substrate 47, and a resistance heating element 51, electrode layer 53, and protective layer 55 are laminated in order thereon. The electrode layer 53 forms a pair of electrodes by being divided on the tip portion of the glaze layer 49. The resistance heating element 51 between respective electrode layers 53 is made to generate the heat, and thereby, the heating element 45 records an image on the receiver sheet 9 through the ink ribbon 7.

The thermal head 5 is structured such that, as shown in FIG. 5, the arrangement direction of the heating elements 45 is the primary scanning direction, and the relative movement direction to the ink ribbon 7 is the secondary scanning direction. A portion of the tip of the heating element 45 is a material contact portion S which comes into contact with the ink ribbon 7. The microscopic irregularity 57 shown in FIG. 6 is provided on the material contact portion S. The microscopic irregularity 57 is preferably formed in the streak-like manner in the direction of the relative movement of the thermal head 5 to the ink ribbon 7.

As can be clearly seen in the example which will be described later, it is preferable that the average roughness Ra of the microscopic irregularity 57 in the perpendicular direction to the scanning direction(the direction perpendicular to the direction of the streak) of the head is 0.03–0.5 $\mu$m. This microscopic irregularity 57 can be easily formed streak-like by inserting an abrasive sheet, not shown, between the heating element 45 and the platen 3, or by the similar method. Further, the microscopic irregularity 57 may be formed by chemical polishing such as etching or the like.

Figure 7:
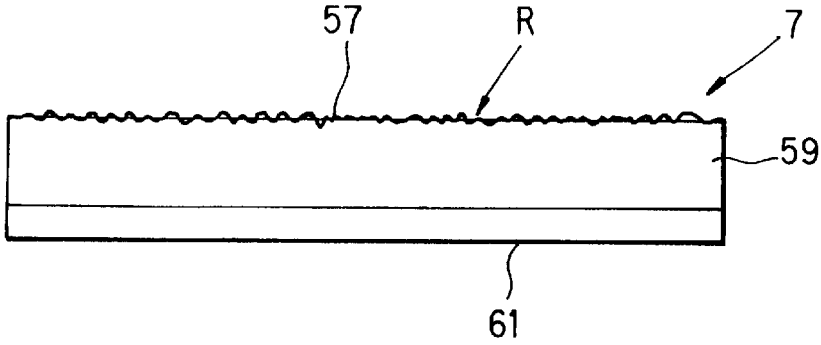
FIG. 7 is a sectional view of an ink ribbon used for the contact type recording head according to the present invention.

Further, the ink ribbon 7 used for the thermal head 5 is formed as shown in FIG. 7 such that one surface of the base material 59 is an ink surface 61, and the other surface is a recording head contact surface R which is brought into contact with the heating element 45. The microscopic irregularity 57 is provided on this recording head contact surface R. In this case, the average roughness Ra of the microscopic irregularity 57 is preferably not more than 0.5 $\mu$m. The microscopic irregularity 57 provided on the recording head contact surface R may be formed by coating, or the irregularity may be formed on the base material 59 itself.

Further, it is preferable that the ink ribbon 7 has practically transparent heat sensitive ink layer whose film thickness is within the range of 0.2–1.0 $\mu$m, which includes pigment of 30–70 weight parts and amorphous organic high polymer of 25–50 weight parts whose softening point is 40–150° C., and the particle diameter of more than 70% of the pigment in the heat sensitive ink layer is not more than 1.0 $\mu$m, and the optical reflection density of the transfer image is at least not less than 1.0 on the white base material (refer to Japanese Patent Publication of Japanese Tokkaihei No. 7-117359).

According to thus structured thermal head 5, the microscopic irregularity is provided on the material contact portion S, therefore, a change of the frictional resistance of the material contact portion S with the ink ribbon 7, which, conventionally, largely changes due to a change of the image-printing rate, is suppressed smaller, and thereby, a printing failure such as a line-jumping, uneven density, or the like, can be improved. Further, when the difference of the change of the frictional resistance of the material contact portion with the recording material is made small, a change of the conveyance driving torque is smaller, and thereby, a burden of the component parts of the apparatus can be decreased, and the durability of the apparatus can be increased. Accordingly, as the result, cost of the apparatus can become low.

Further, the microscopic irregularity 57 is formed in a streak-like manner in the direction of the relative movement, therefore, the friction at the time of relative movement is not increased, and the contact surface of the thermal head 5 with the ink ribbon 7 is decreased. When the microscopic irregularity is provided on the recording material side so that the friction is reduced, the recording density of the recording material itself is decreased and cost of the recording material is increased. According to the contact type recording head of the present invention, the microscopic irregularity is formed on the recording head itself, and therefore, no surface processing is necessary for the recording material. Accordingly, common recording material without microscopic irregularity can be used on the ordinary density characteristic, without any increase of impressed energy onto the recording head, thereby, the recording cost can be reduced.

Further, because the contact area of the material contact portion S is decreased, even if the wax coated on the ink ribbon 7 and the receiver sheet 9 is fused, a change of the frictional resistance can be suppressed to be small.

Further, even when the ink ribbon 7 has the high flatness in which the average roughness is not more than 0.5 μm, it is coupled with the roughness of the head, therefore, a change of the frictional resistance can be small and stable by the multiplication of the two, thereby, a change of the frictional resistance can be more effectively suppressed. Accordingly, the printing failure can be prevented.

Example

Next, thermal heads having different roughness of material contact portions, are used, and actually image-printing is conducted and the condition of generation of the line-jumping and uneven density is checked. The result of the check will be described.

Incidentally, the image-printing is conducted under the following conditions.

[Printing Condition]

Recording head: resolution in the primary scanning direction:
604.8 dpi
heater size: 32 μm in the primary scanning direction, 40 μm in the subsidiary scanning direction Head resistance value: 3000 Ω

Supply voltage: 9 V

Image receiving sheet: Fuji Film Co. Digital color Proofer First Proof Receiver sheet A3W Thermal transfer ribbon: Fuji Film Co. Digital color Proofer
First Proof Proof-ribbon J Further, as the recording head, 8 types of A–H heads in which the microscopic irregularity of the different average roughness is formed on the material contact portion, are used. The measurement result of the average roughness Ra, maximum roughness Rmax, maximum height Rp, maximum depth Rv, range Rt, and average roughness in 10 points Rz with respect to these thermal heads A–H, is shown in Table 1.

Figure 8:
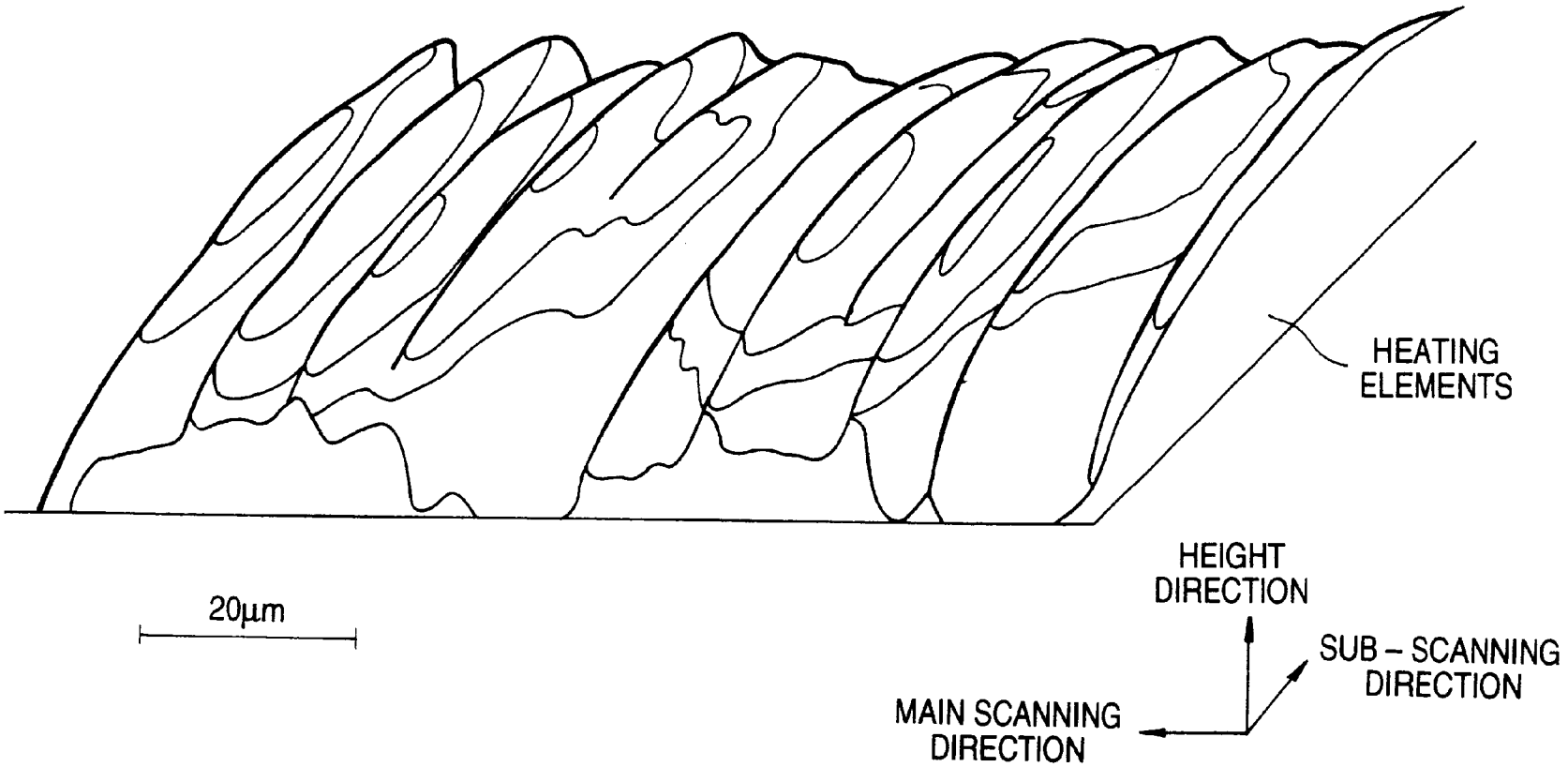
FIG. 8 is an enlarged perspective view showing contour lines of the heating element on which microscopic irregularity is formed.
Figure 9:
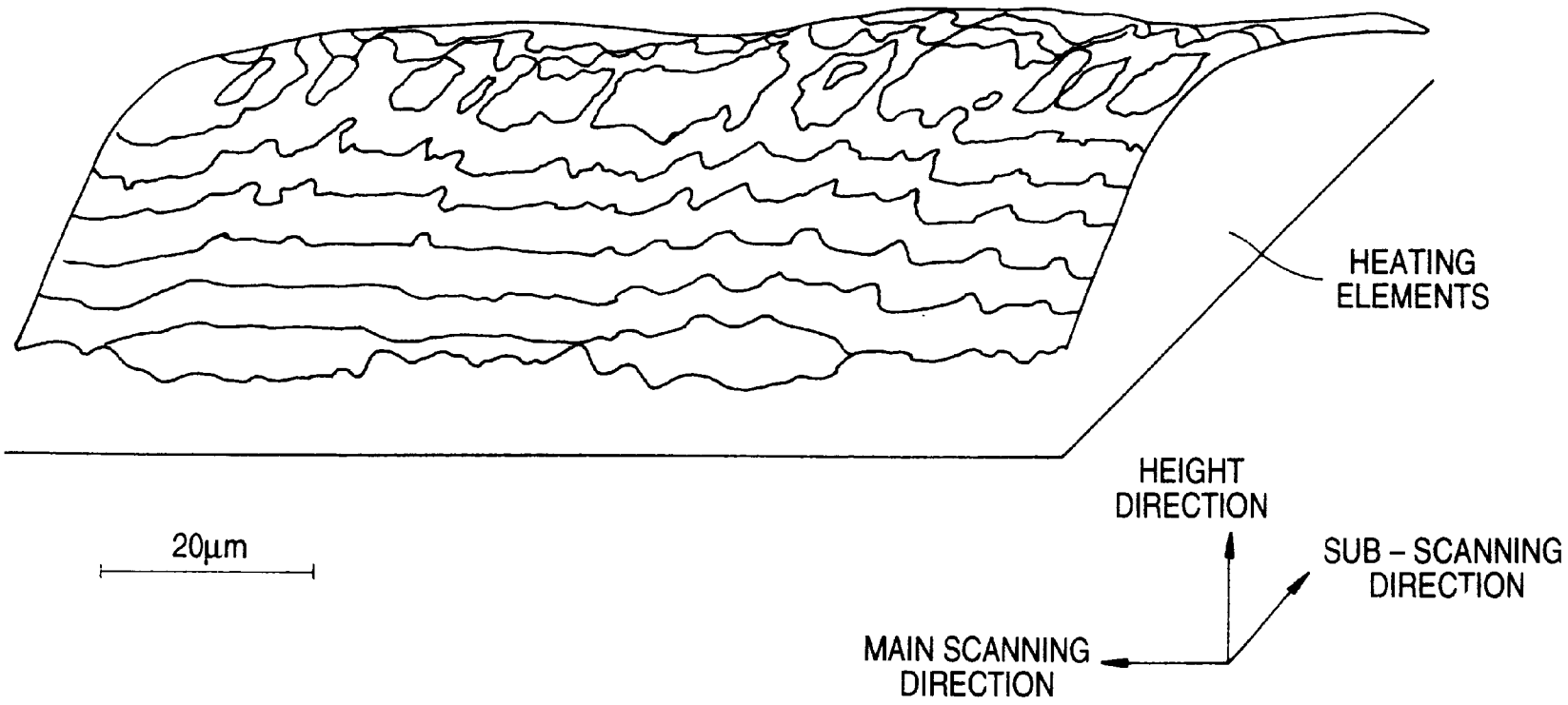
FIG. 9 is an enlarged perspective view showing contour lines of another heating element on which the microscopic irregularity is formed.
Figure 10:
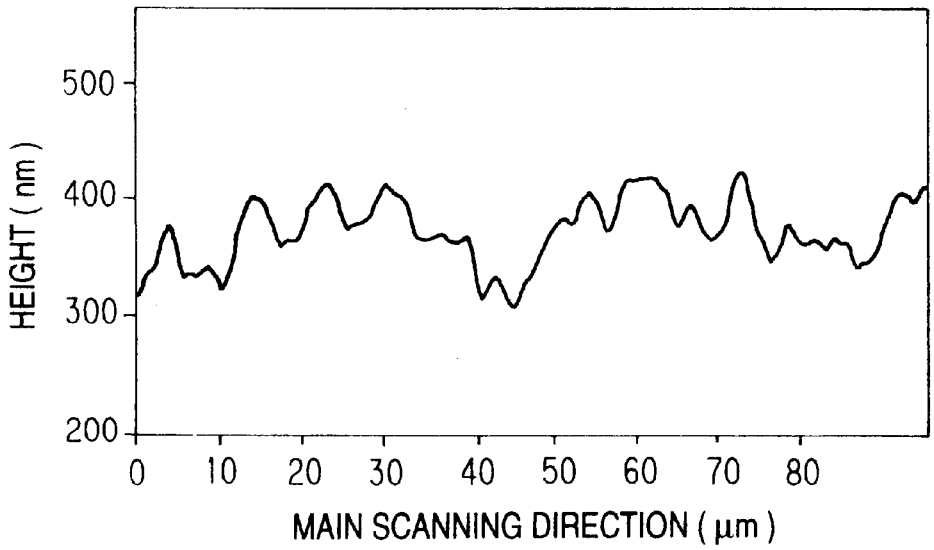
FIG. 10 is a graph showing a distribution of the height of the microscopic irregularity shown in FIG. 8 in the primary scanning direction.
Figure 11:
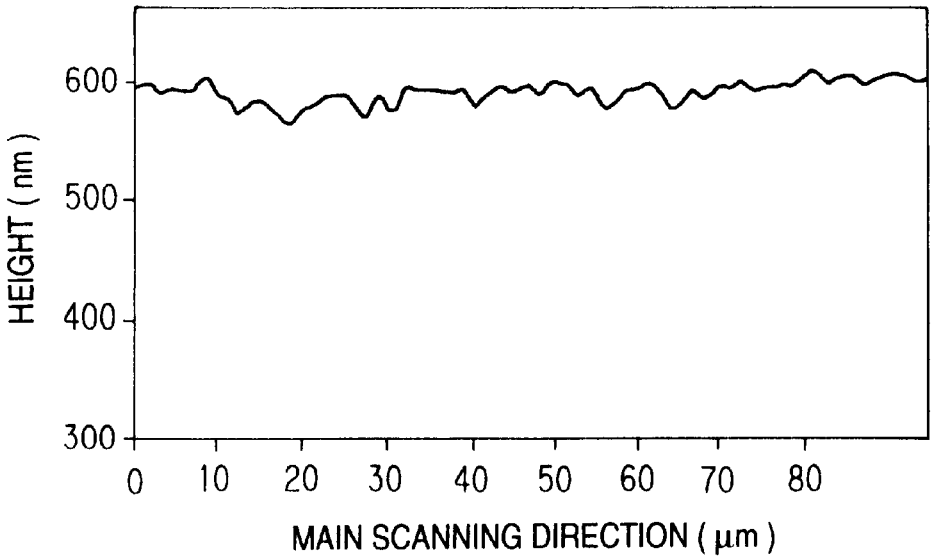
FIG. 11 is a graph showing a distribution of the height of the microscopic irregularity shown in FIG. 9 in the primary scanning direction.

Herein, FIG. 8 is an example of the heating element corresponding to the surface roughness of the thermal heads C, D, E, and an enlarged perspective view showing contour lines on the material contact portion. FIG. 9 is an example of the heating element corresponding to the surface roughness of the thermal heads F, G, H, and an enlarged perspective view showing contour lines on the material contact portion. Further, FIG. 10 is a graph showing a distribution of the height of the microscopic irregularity shown in FIG. 8 in the primary scanning direction. FIG. 11 is a graph showing a distribution of the height of the microscopic irregularity shown in FIG. 9 in the primary scanning direction.

Figure 12:
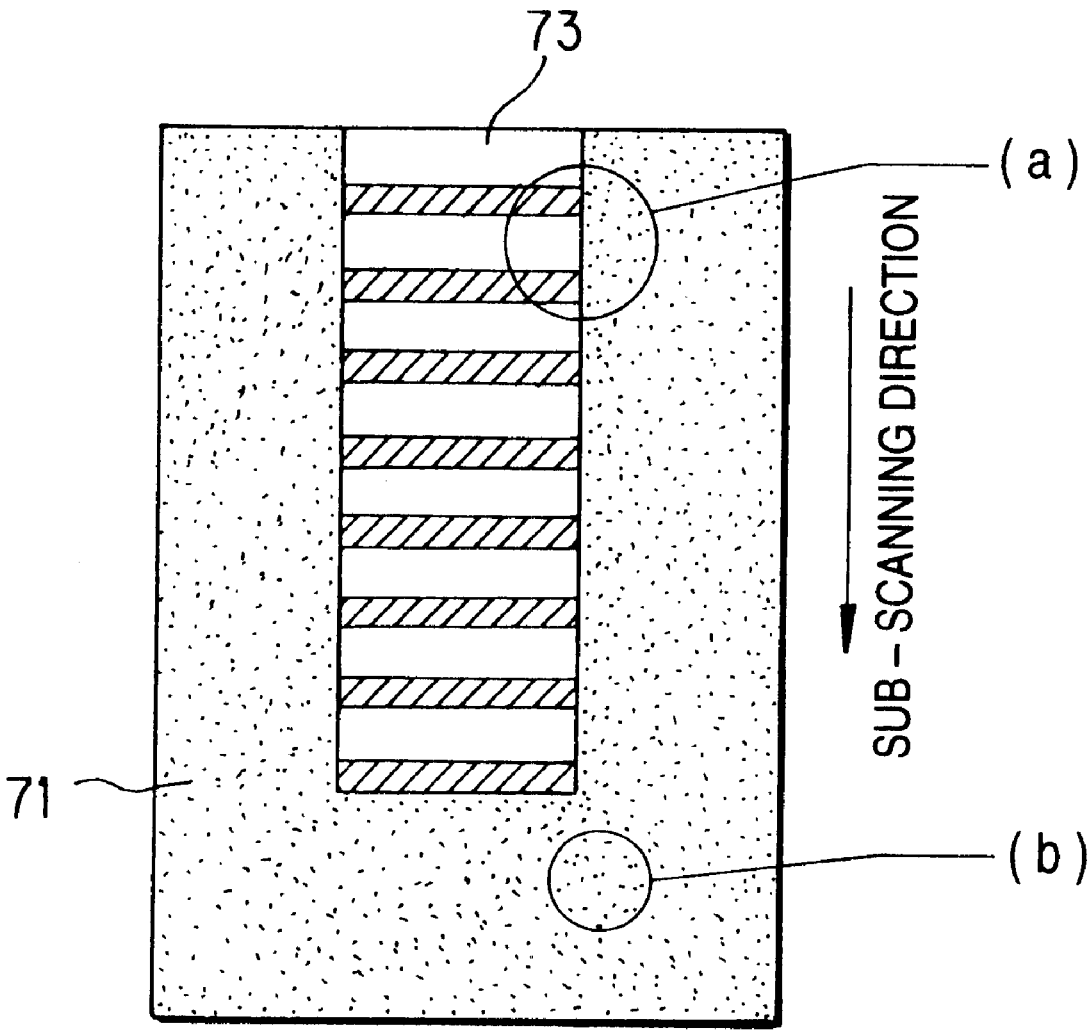
FIG. 12 is an explanatory view of an evaluation image.

According to the above printing conditions, the evaluation image shown in FIG. 12 is practically printed, and a condition of generation of the load variation streak and uneven density with respect to the thermal heads A–H which are produced under respectively different conditions, is also shown together in Table 1.

TABLE 1

| Thermal Head | Ra (μm) Average roughness | Rmax Maximum roughness | Rp Maximum height | Rv Maximum depth | Rt Range | Rz 10 point average | Load variation streak | uneven density |
|---|---|---|---|---|---|---|---|---|
| A | 0.9492 | 1.1170 | 2.841 | −2.172 | 6.013 | 4.974 | ○ | X |
| B | 0.6120 | 0.6920 | 4.017 | −2.501 | 6.510 | 4.349 | ○ | X |
| C | 0.3690 | 0.3220 | 1.839 | −1.796 | 3.640 | 3.013 | ○ | ○ |
| D | 0.0449 | 0.0374 | 0.0849 | −0.1149 | 0.1998 | 0.1748 | ○ | ○ |
| E | 0.0449 | 0.0424 | 0.0924 | −0.1249 | 0.2173 | 0.1374 | Δ○ | ○ |
| F | 0.0124 | 0.0124 | 0.0724 | −0.0324 | 0.1049 | 0.0574 | Δ | ○ |
| G | 0.0074 | 0.0049 | 0.0224 | −0.0274 | 0.0499 | 0.0399 | X | ○ |
| H | 0.0074 | 0.0099 | 0.0249 | −0.0249 | 0.0499 | 0.0349 | X | ○ |

As shown in FIG. 12, when a pattern in which an intermediate color printing area 71 to continuously print the intermediate color in the subsidiary scanning direction, and a binary level printing area 73 to alternately print white or black in the subsidiary scanning direction, are mixed, is printed, the difference of the printing quality is clearly generated among respective thermal heads.

Figure 13A:
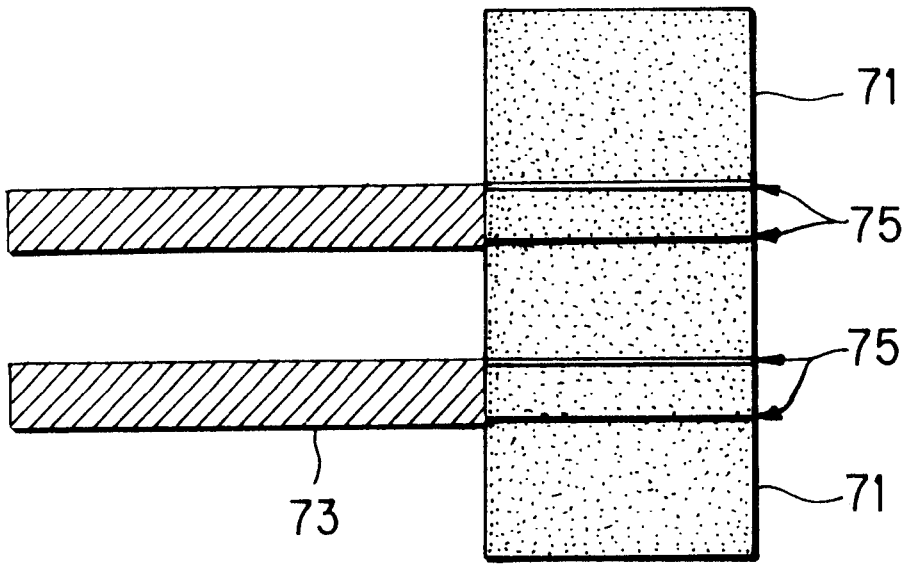
FIG. 13 is a partial enlarged view of a printing-image in which a portion A in FIG. 12 is shown by (a), and a portion B in FIG. 12 is shown by (b).
Figure 13B:
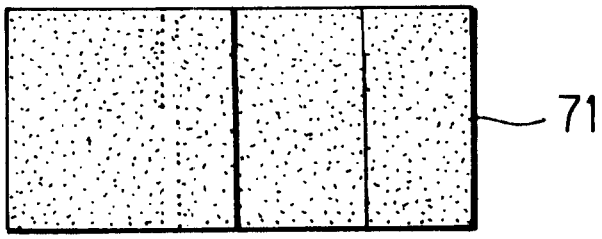

That is, with respect to thermal heads A and B, a line having the density difference as shown in FIG. 13(*a*), showing magnified portion (a) indicated in FIG. 12, does not occur, but the uneven density occurs by generated streak due to the excessively high microscopic irregularity as shown in FIG. 13(*b*) showing magnified portion (b) indicated in FIG. 12. Further, with respect to thermal heads F, G and H, the frictional resistance changes due to a variation of the image-printing rate of the binary level printing area 73, and therefore, the line-jumping (white streak or black streak) 75 which is generated in the line-like manner in the intermediate color printing area 71 as shown in FIG. 13(*a*), occurs.

On the other hand, with respect to thermal heads C, D and E, good printing without line-jumping and uneven density can be performed.

From the above-described results, it is confirmed that, when the average roughness Ra of the microscopic irregularity formed on the head is within the range of 0.03–0.5 $\mu$m, a change of the frictional resistance of the material contact portion with the material, which changes due to a variation of the image-printing rate, can be reduced, thereby, printing failures such as line-jumping, uneven density, or the like, can be fairly improved.

Incidentally, in the above embodiment, a case where the contact type recording head is the thermal head, is explained as an example, however, the contact type recording head according to the present invention can take the same effect as described above, even when it is applied to another recording type head which prints an image while being in contact with the recording material.

Further, in the contact type recording head according to the present invention, the recording material is not limited to the thermal transfer recording material, but even when it is the heat sensitive material or the photosensitive heat sensitive transfer material, the same effect as described above can be obtained.

Herein, as a material of the photosensitive heat sensitive transfer layer (image recording layer)of the photosensitive heat sensitive transfer material, the following can be listed: the photosensitive heat sensitive recording layer using the recording material which includes electron donative achromatic dye included in the thermo-responsive micro-capsule, and other than micro-capsule, compound having electron acceptance portion and polymeric vinyl monomer portion in the same molecule and photo polymerization initiator (for example, a method disclosed in Japanese Tokkaihei No. 4-249251, etc.); or the photosensitive heat sensitive recording layer using the recording material which includes electron donative achromatic dye included in the thermo-responsive micro-capsule, and other than micro-capsule, electron acceptable compound, polymeric vinyl monomer and photo polymerization initiator (for example, a method disclosed in Japanese Tokkaihei No. 4-211252, etc.).

According to the contact type recording head of the present invention and the image forming apparatus using this recording head, the microscopic irregularity is provided on the material contact portion, therefore, a change of the frictional resistance of the material contact portion with the recording material, which conventionally, largely changes due to a change of the image-printing rate, can be reduced, and a printing failure such as line-jumping, uneven density, or the like, can be improved. Further, when the difference of the change of the frictional resistance of the material contact portion with the recording material is made small, a change of the conveyance driving torque is also smaller, and thereby, the durability of the component parts of the apparatus can be increased.

Disclosed embodiment can be varied by a skilled person without departing from the sprit and scope of the invention, which is intended to be encompassed by the following claims:

What is claimed is:

1. A contact type recording head which moves relatively with respect to a recording material with bringing a portion thereof into contact with the recording material, and prints an image directly onto the recording material or prints an image indirectly onto an image receiving material through the recording material, wherein microscopic irregularity is provided on a material contact portion which contacts with the recording material wherein the microscopic irregularity is formed in a streak-like shape in the direction of the relative movement.

2. The contact type recording head according to claim 1, wherein the microscopic irregularity has an average roughness of 0.03–0.5 $\mu$m in the direction perpendicular to the direction of the relative movement.

3. The contact type recording head according to claim 1, wherein a plurality of heating elements are arranged in the array-like manner on the material contact portion.

4. An image forming apparatus comprising:

a contact type recording head which moves relatively with respect to a recording material while bringing a portion of the recording head in contact with the recording material, and records an image directly onto the recording material or records the image indirectly onto an image receiving material through the recording material;

a platen disposed at an opposite side of the contact type recording head; and transfer means for forming the image by conveying the recording material for image recording or conveying the image receiving material overlaid by the recording material while being pressed together, wherein microscopic irregularity is provided on a material contact portion where the recording head contacts with the recording material.

5. The image forming apparatus according to claim 4, wherein the microscopic irregularity is formed in a streak-like shape in the direction of the relative movement.

6. The image forming apparatus according to any one of claims 4 or 5, wherein the microscopic irregularity has an average roughness of 0.03–0.5 $\mu$m in the direction perpendicular to the direction of the relative movement.

7. The image forming apparatus according to any one of claims 4 or 5, wherein plurality of heating elements are arranged in the array-like manner on the material contact portion.

8. The image forming apparatus according to claim 4, wherein the average roughness of the surface of the recording material on which the recording head slides, is not more than 0.5 $\mu$m.

9. The image forming apparatus according to either one of claims 4 or 5, wherein the recording material is one of: thermal transfer recording material and heat sensitive material.

10. The image forming apparatus according to either one of claims 4 or 5, wherein the recording material is one of further comprised of:

heat sensitive transfer recording material which includes pigment of 30–70 weight parts and amorphous organic high polymer of 25–50 weight parts of which softening point is 40–150° C.

practically transparent heat sensitive ink layer of which film thickness is within the range of 0.2–1.0 μm, in which the particle diameter of more than 70% of the pigment in the heat sensitive ink layer is not more than 1.0 μm;

and the optical reflection density of the transfer image is at least not less than 1.0 on the white base material.

11. A contact type recording head which moves relatively with respect to a recording material with bringing a portion thereof into contact with the recording material, and prints an image directly onto the recording material or prints an image indirectly onto an image receiving material through the recording material, wherein microscopic irregularity is provided on a material contact portion which contacts with the recording material;

wherein the microscopic irregularity has an average roughness of 0.03–0.5 μm in the direction perpendicular to the direction of the relative movement.

12. A contact type recording head which moves relatively with respect to a recording material with bringing a portion thereof into contact with the recording material, and prints an image directly onto the recording material or prints an image indirectly onto an image receiving material through the recording material, wherein microscopic irregularity is provided on a material contact portion which contacts with the recording material;

wherein a plurality of heating elements are arranged in the array-like manner on the material contact portion.

* * * * *